US010436076B2

(12) United States Patent
Zhang

(10) Patent No.: US 10,436,076 B2
(45) Date of Patent: Oct. 8, 2019

(54) LOW TEMPERATURE HEAT SOURCE THERMOELECTRIC CONVERSION SYSTEM USING BLEND REFRIGERANT

(71) Applicant: Gaozuo Zhang, Shanghai (CN)

(72) Inventor: Gaozuo Zhang, Shanghai (CN)

( * ) Notice: Subject to any disclaimer, the term of this patent is extended or adjusted under 35 U.S.C. 154(b) by 58 days.

(21) Appl. No.: 15/108,477

(22) PCT Filed: Dec. 11, 2015

(86) PCT No.: PCT/CN2015/097090

§ 371 (c)(1),
(2) Date: Jun. 27, 2016

(87) PCT Pub. No.: WO2016/206318

PCT Pub. Date: Dec. 29, 2016

(65) Prior Publication Data

US 2017/0145866 A1 May 25, 2017

(30) Foreign Application Priority Data

Jun. 24, 2015 (CN) ..... 2015 1 0354427

(51) Int. Cl.

| | |
|---|---|
| ***F01K 25/10*** | (2006.01) |
| ***F01K 7/16*** | (2006.01) |
| ***F01K 25/08*** | (2006.01) |
| ***F01D 15/10*** | (2006.01) |
| ***F28B 1/02*** | (2006.01) |
| ***F28D 3/02*** | (2006.01) |

(Continued)

(52) U.S. Cl.
CPC ..... *F01K 25/106* (2013.01); *F01D 15/10* (2013.01); *F01K 7/16* (2013.01); *F01K 25/08* (2013.01); *F22B 1/021* (2013.01); *F22B 27/16* (2013.01); *F28B 1/02* (2013.01); *F28D 3/02* (2013.01); *F05D 2220/31* (2013.01)

(58) Field of Classification Search
CPC ..... F01K 25/08–14
See application file for complete search history.

(56) References Cited

U.S. PATENT DOCUMENTS 3,505,810 A * 4/1970 Mamiya ..... F01K 25/065 60/649
3,908,381 A * 9/1975 Barber ..... F01K 3/267 60/641.4

(Continued)

*Primary Examiner* — Laert Dounis
(74) *Attorney, Agent, or Firm* — Houtteman Law LLC

(57) ABSTRACT

The invention provides a low temperature heat source thermoelectric conversion system using a blend refrigerant, comprising an evaporator, sprinkler, a first heater and a second heater are successively arranged from the top down in the evaporator, a hot well containing a blend refrigerant is connected to the sprinkler through a pipeline with a booster transfer pump, a steam dryer is arranged at the upper part of the evaporator, the steam dryer is connected with an intake end of a turbine through a pipeline, the turbine is connected with a generator, and an exhaust end of the turbine is connected with a mixer through a pipeline, a reflux device is arranged at the lower part of the evaporator, the reflux device is connected with the mixer through a pipeline, and the mixer is connected with a condenser. The invention further provides a low temperature heat source thermoelectric conversion method using a blend refrigerant.

1 Claim, 2 Drawing Sheets

(51) Int. Cl.
*F22B 1/02* (2006.01)
*F22B 27/16* (2006.01)

(56) References Cited

U.S. PATENT DOCUMENTS

| | | | | |
|---|---|---|---|---|
| 2011/0051880 | A1* | 3/2011 | Al-Mayahi | F01K 25/06 376/370 |
| 2016/0108762 | A1* | 4/2016 | Mahmoud | F01K 25/08 60/651 |

* cited by examiner

LOW TEMPERATURE HEAT SOURCE THERMOELECTRIC CONVERSION SYSTEM USING BLEND REFRIGERANT

FIELD OF THE INVENTION

The invention relates to a low temperature heat source thermoelectric conversion system, in particular to a low temperature heat source thermoelectric conversion system using a blend refrigerant.

DESCRIPTION OF THE RELATED ART

At present, most of thermal power systems use single-component refrigerants with fixed boiling points and adopt Rankine cycle technology, the efficiency of such thermal power systems is restricted by constant boiling temperature. Due to large latent heat of vaporization, the temperature of a heat source shows a linear decrease during heat dissipation. Before reaching the boiling point in the endothermic process, the temperature rise of a refrigerant with a fixed boiling point, like the heat dissipation characteristics of the heat source, shows a linear relationship. The refrigerant continues to absorb heat for vaporization after reaching the boiling temperature while keeping the temperature unchanged during vaporization until the liquid refrigerant is completely converted into vaporized refrigerant. That is, a large amount of heat must be absorbed from the heat source during vaporization, but the temperature difference with the heat source cannot keep a linear relationship, thus the efficiency of the whole thermal power system is restricted.

U.S. Pat. No. 4,346,561 granted to Alexander I. Kalina discloses a Kalina cycle technology. Kalina cycle is an "improvement" based on Rankine cycle, which uses an ammonia-water "mixture" instead of a "pure" circulating medium. The physical characteristics of the ammonia-water mixture are different from neither pure water nor pure ammonia. The Kalina cycle technology uses two different refrigerants with stable boiling points and capable of forming unfixed boiling points, the refrigerants can keep parallel with linear temperature drop characteristics in the heat dissipation process of the heat source, and can also keep the temperature rise characteristics during vaporization phase change approximately parallel with the linear temperature drop characteristics in the heat dissipation process of the heat source, thus improving the efficiency of the whole thermal power system.

In combination with FIG. 1, the Kalina cycle process is roughly as follows: a refrigerant is pumped from a hot well into a separate type heat exchanger through an ammonia pump, the heated refrigerant is separated into rich ammonia and lean aqueous ammonia through a separator, the rich ammonia is sent into an ammonia steam turbine to do work, exhaust steam is sent into a condenser, and the lean aqueous ammonia is delivered to the condenser. After cooling by a cold source, vaporized refrigerant is gradually absorbed by the refrigerant lean liquid, and the resulting mixture is finally sent into the hot well in a liquid state to complete a thermoelectric conversion cycle.

According to the cycle process, the key of a blend refrigerant to implement a cycle is the absorption efficiency of vaporized refrigerant by the refrigerant lean liquid in the condenser. The absorption efficiency depends on the following factors:

1) backpressure of vaporturbine;
2) flow ratio of vaporized refrigerant rich to the refrigerant lean liquid; and 3) flow rate of cooling water with a certain temperature. It takes away heat released by the process of the refrigerant lean liquid lean absorbing the rich.

Among the factors, the flow ratio of vaporized refrigerant to the refrigerant lean liquid is the most important factor. In the U.S. Pat. No. 434,656 patent document, the "lean aqueous ammonia→condenser" process is operated by a manual or electric valve depending only on the experience of operators. As the actual flow, temperature and density of liquid refrigerant from the separator cannot be known online, actual flow deviations of liquid and vaporized refrigerants are generally 10% to 15% over the design values in the "lean aqueous ammonia→condenser" process manually operated by skilled operators, as a result, refrigerants cannot be mixed at a precise proportion, thus liquid and vaporized refrigerants cannot be completely liquefied, the cycle efficiency of the system is decreased, and the backpressure of the steam turbine cannot be stabilized at the design value, making it difficult to adjust the volume of cooling water and operating conditions of cooling towers.

In addition, according to the cycle process, the refrigerant to be heated leaves the booster pump, and successively passes through separate type heaters, steam-water separators, isolation valves associated with separating devices, control valves and connecting pipelines, resulting in land occupation and difficulty in layout, improving the engineering cost, increasing local resistance loss along the pipeline of refrigerant in front of the steam turbine inlet by about 8%-10%, and reducing shaft output power of the steam turbine and effective output power of the generator by about 7%-9%.

SUMMARY OF THE INVENTION

A technical problem to be solved by the invention is how to precisely control the flow ratio of vaporized refrigerant to the refrigerant lean liquid, so that the refrigerant lean liquid can completely absorb the vaporized refrigerant for liquidation, thus improving the cycle efficiency of the system.

In order to solve the technical problem, the technical solution of the invention is to provide a low temperature heat source thermoelectric conversion system using a blend refrigerant, characterized by comprising a evaporator. A sprinkler, a first heater and a second heater are successively arranged from the top down in the evaporator, a hot well containing a blend refrigerant is connected to the sprinkler through a pipeline with a booster transfer pump, a steam dryer is arranged at the upper part of the evaporator, the steam dryer is connected with an intake end of a turbine through a pipeline, the turbine is connected with a generator, and an exhaust end of the turbine is connected with a mixer through a pipeline, a reflux device is arranged at the lower part of the evaporator, the reflux device is connected with the mixer through a pipeline, and the mixer is connected with a condenser.

Preferably, the blend refrigerant satisfies the following two conditions at the same time: 1. more than two refrigerants with stable chemical compositions; and 2. more than two different refrigerants with stable boiling points and capable of forming unfixed boiling points.

Preferably, the first heater and the second heater share the same low temperature heat source, that is, the low temperature heat source enters the first heater, and then enters the second heater from the first heater.

Preferably, the temperature of heat transfer surfaces of the first heater and the second heater is higher than the boiling temperature of the blend refrigerant.

Preferably, cooling water is introduced in the condenser.

Preferably, a flow control valve is arranged on the pipeline connecting the reflux device with the mixer.

Preferably, a level line in the evaporator is located below the first heater.

The invention further provides a low temperature heat source thermoelectric conversion method using a blend refrigerant, characterized by using the low temperature heat source thermoelectric conversion system using a blend refrigerant, comprising the following steps:

step 1: the blend refrigerant in the hot well is pumped into the sprinkler inside the evaporator through the booster transfer pump, the blend refrigerant comes into contact with the surface of the first heater with temperature higher than the boiling temperature of the blend refrigerant through the sprinkler to allow refrigerant with boiling temperature lower than the surface temperature of the first heater in the blend refrigerant to partially vaporize;

step 2: vaporized refrigerant separated out first flows to the steam dryer, non-vaporized blend refrigerant enters the lower part of the evaporator to form a level line, refrigerant below the level line is unceasingly heated by a heat transfer surface of the second heater with temperature higher than the boiling temperature of the blend refrigerant to unceasingly separate out vaporized refrigerant flowing to the steam dryer, and liquid particles in the vaporized refrigerant are removed in the steam dryer;

step 3: dry vaporized refrigerant from the steam dryer is transfused to the turbine, the vaporized refrigerant is expanded to do work in blade passages of the turbine to be converted into mechanical energy, and drive the generator to supply electric power to a grid in the form of electricity, and exhaust steam with work done in the turbine is discharged to the mixer;

step 4: remaining vaporized refrigerant below the level line in the evaporator and with partial boiling temperature lower than the surface temperature of the first heater undergoes further vaporization under heating from the heat transfer surface of the second heater, and non-vaporized refrigerant with high density tends to stay at the lower part of the evaporator to form an area with minimum concentration of refrigerant components with the boiling temperature lower than the surface temperature of the first heater in the reflux device; and step 5: liquid refrigerant is taken from the reflux device based on the total amount of refrigerant pumped by the booster transfer pump into the evaporator as well as the component ratio of the refrigerant with the boiling temperature lower than the surface temperature of the first heater and the design level line, and delivered to the mixer to mix with the discharged exhaust vapor with work done in the turbine, the exhaust vapor and the non-vaporized blend refrigerant are fully mixed in the mixer, and then led to the condenser, after the vapor and liquid mixture is cooled in the condenser, vaporized refrigerant is gradually absorbed by the refrigerant lean liquid, and the mixture is finally transferred into the hot well in a liquid state to complete a thermoelectric conversion cycle.

Preferably, the amount of liquid refrigerant taken from the reflux device is precisely controlled by multi-impulse control of the level line of the evaporator in the step 5.

Preferably, reference parameters for multi-impulse control of the level line of the evaporator include flow, temperature and density of vaporized refrigerant at the inlet of the turbine, flow, temperature and density of liquid refrigerant at the outlet of the booster transfer pump, and flow, temperature and density of the refrigerant lean liquid in the pipeline between the outlet of the reflux device and the inlet of the mixer.

Compared with the prior art, the invention has the following beneficial effects:

1. combining separate type blend refrigerant heaters, separators and liquid refrigerant reflux devices used in traditional technology into an integrated device, optimizing system functions, reducing project investment, reducing the flow resistance of the refrigerant in front of the turbine inlet, and improving the thermoelectric conversion efficiency of the heat source.
2. Improving the efficiency of the cycle condensing process, and improving the cycle efficiency accordingly.
3. Improving the steam-liquid separation efficiency after the use of a two-stage heater.
4. Improving the operating conditions and efficiency of the turbine through improvement of the steam-liquid separation efficiency.
5. Designing and arranging a mixer in the condenser, so that the refrigerant lean liquid from the reflux device and vaporized refrigerant from the turbine can be mixed at a precise proportion of weight flow, and the vapor and the refrigerant lean liquid can be uniformly distributed.
6. Integrating the hot well and the condenser, simplifying the process, reducing the backpressure of the turbine, and helping improve the thermoelectric conversion efficiency of the heat source.
7. Less equipment parts, simple system structure, low cost and easy operation.

DESCRIPTION OF THE PREFERRED EMBODIMENT

The invention is described in detail in combination with the following drawings and preferred embodiments for clear understanding.

The invention provides a low temperature heat source thermoelectric conversion system using a blend refrigerant. The blend refrigerant satisfies the following two conditions: (1) more than two refrigerants with stable chemical compositions; and (2) more than two different refrigerants with stable boiling points and capable of forming unfixed boiling points. The (1) refers to a mechanical mixture of more than two chemical compositions without chemical reaction, such as an ammonia-water mixture at any ammonia-water ratio, or a mixture of ammonia, water and other refrigerant. The low temperature heat source refers to a heat source with temperature higher than the boiling temperature of the refrigerant and containing industrial process waste heat, solar energy, terrestrial heat, etc. Thermoelectric conversion refers that low-grade heat energy of the low temperature heat source is converted into electric energy output to the grid.

Figure 1:
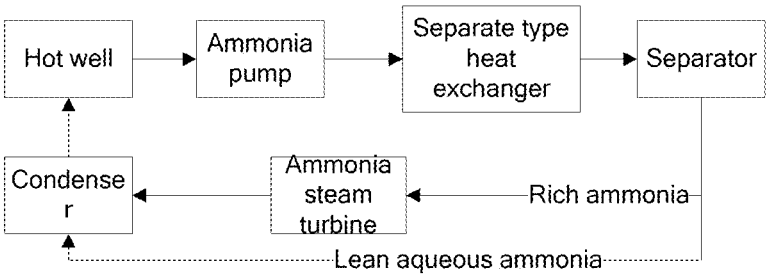
Figure 1 Prior Art
FIG. 1 is a schematic diagram of a Kalina cycle process.
Figure 2:
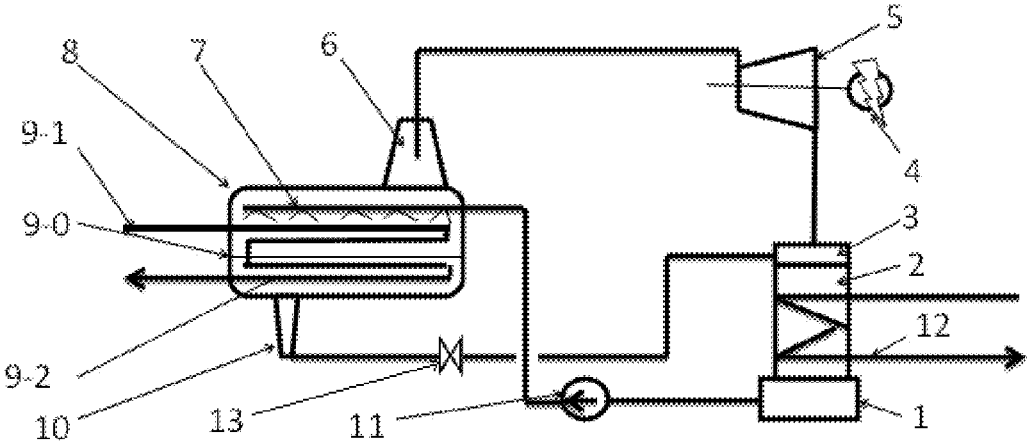
FIG. 2 is a schematic diagram of a low temperature heat source thermoelectric conversion system using a blend refrigerant provided by the invention.

FIG. 2 is a schematic diagram of a low temperature heat source thermoelectric conversion system using a blend refrigerant provided by the invention. The low temperature heat source thermoelectric conversion system using a blend refrigerant comprises a hot well (1) containing a blend refrigerant, one end of the booster transfer pump (11) is connected with the hot well (1) through a pipeline, and the other end is connected to an evaporator (8) through a pipeline, a steam dryer (6) is arranged at the upper part of the evaporator (8), the steam dryer (6) is connected with an intake end of a turbine (5) through a pipeline, the turbine (5) is connected with a generator (4), and an exhaust end of the turbine (5) is connected with a mixer (3) through a pipeline, a reflux device (10) is arranged at the lower part of the evaporator (8), the reflux device (10) is connected with the mixer (3) through a pipeline, the mixer (3) is connected with a condenser (2), and cooling water (12) is introduced in the condenser (2).

A sprinkler (7), a first heater (9-1) and a second heater (9-2) are successively arranged from the top down in the evaporator (8), the sprinkler (7) is located at the top in the evaporator (8) and connected with the booster transfer pump (11). The first heater (9-1) and the second heater (9-2) share the same low temperature heat source, that is, the low temperature heat source enters the first heater (9-1), and then enters the second heater (9-2) from the first heater (9-1).

A flow control valve (13) is arranged on the pipeline connecting the reflux device (10) with the mixer (3).

Figure 3:
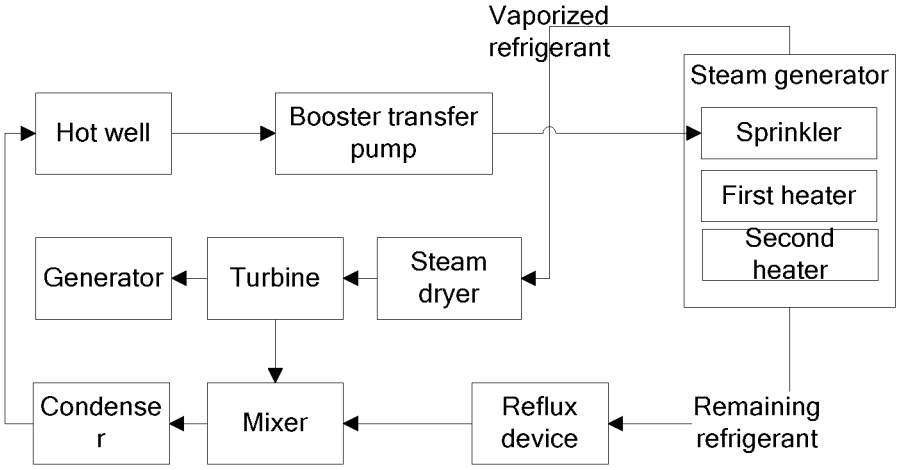
FIG. 3 is a schematic diagram of a cycle process of the system provided by the invention.

In combination with FIG. 3, the operating method of the system is as follows:

the blend refrigerant in the hot well (1) is pumped into the evaporator (8) through the booster transfer pump (11), the blend refrigerant from the booster transfer pump (11) comes into contact with the surface of the first heater (9-1) with temperature higher than the boiling temperature of the blend refrigerant through the sprinkler (7) to allow refrigerant with boiling temperature lower than the surface temperature of the first heater (9-1) in the blend refrigerant to partially vaporize;

vaporized refrigerant separated out first flows to the steam dryer (6), non-vaporized blend refrigerant enters the lower part of the evaporator (8) to form a level line (9-0), refrigerant below the level line (9-0) is unceasingly heated by a heat transfer surface of the second heater (9-2) with temperature higher than the boiling temperature of the blend refrigerant to unceasingly separate out vaporized refrigerant flowing to the steam dryer (6), and liquid particles in the vaporized refrigerant are removed in the steam dryer (6);

dry vaporized refrigerant with liquid particles being removed in the steam dryer (6) is transfused to the turbine (5), intrinsic energy (pressure and enthalpy) of the vaporized refrigerant is expanded to do work in blade passages of the turbine (5) to be converted into mechanical energy, and drive the generator (4) to supply electric power to a grid in the form of electricity;

exhaust steam with work done in the turbine (5) is discharged to the mixer (3);

remaining vaporized refrigerant below the level line (9-0) in the evaporator (8) and with partial boiling temperature lower than the surface temperature of the first heater (9-1) undergoes further vaporization under heating from the heat transfer surface of the second heater (9-2), and non-vaporized refrigerant with high density tends to stay at the lower part of the evaporator (8) to form an area with minimum concentration of refrigerant components with the boiling temperature lower than the surface temperature of the first heater (9-1) in the reflux device (10); and the refrigerant lean liquid is taken from the reflux device (10) based on the total amount of refrigerant pumped by the booster transfer pump (11) into the evaporator (8) as well as the component ratio of the refrigerant with the boiling temperature lower than the surface temperature of the first heater (9-1) and the level line (9-0), and delivered to the mixer (3) to mix with the discharged exhaust steam with work done in the turbine (5), the exhaust steam and the non-vaporized blend refrigerant are fully mixed in the mixer (3), and then led to the condenser (2), after the steam and liquid mixture is cooled by the cooling water system (12) in the condenser (2), vaporized refrigerant is gradually absorbed by the refrigerant lean liquid, and the mixture is finally transferred into the hot well (1) in a liquid state to complete a thermoelectric conversion cycle.

In the process of "delivering the refrigerant lean liquid from the reflux device (10) to the mixer (3)" of the invention, the amount of the refrigerant lean liquid taken from the reflux device (10) is precisely controlled by multi-impulse control of the design level line (9-0), thus improving the mixing process of the refrigerant lean liquid delivered to the mixer (3) and the discharged exhaust vapor with work done in the turbine (5), and improving the absorption efficiency of vaporized refrigerant by the refrigerant lean liquid in the condenser (2). The specific method comprises the following steps:

1. setting the level line (9-0) in the evaporator (8), and designing the level line as a control goal based on different heat sources and output power;
2. setting measuring points for flow, temperature and density of the vaporized refrigerant at the inlet of the turbine (5), the parameter group supports the booster transfer pump (11) to control the output power and realize level line control;
3. setting sampling points for flow, temperature, density and other operating parameters of the pumped liquid refrigerant on the outlet pipeline of the booster transfer pump (11), the parameter group is used as a basis for control of output power, and also a basis for control and comparison of liquid flow into the mixer (3); and
4. setting sampling points for flow, temperature, density and other operating parameters of the refrigerant lean liquid on the pipeline from the outlet of the reflux device (10) to the inlet of the mixer (3), the parameter group is used as a basis for control, comparison and online setup of liquid flow into the mixer (3).

The amount of the refrigerant lean liquid taken from the reflux device (10) can be obtained after operation by using a PID control algorithm based on the control parameters. Liquid and vaporized refrigerants in the mixer (3) can be mixed at a precise proportion through control of the flow control valve (13), so that the refrigerant lean liquid can complete absorb and liquefy the vaporized refrigerant, stabilizing the backpressure of the turbine, improving the cycle efficiency. and making it convenient to adjust the volume of cooling water and operating conditions of cooling towers.

As a control goal is set for the "reflex device→mixer" process and the control goal is realized by multi-impulse control in the invention, with the control precision not lower than 1%, the mixing efficiency is improved by about 10%, and the cycle efficiency is improved by about 2% in the invention compared with the U.S. Pat. No. 434,656 patent.

What is claimed is:

1. A low temperature heat source thermoelectric conversion method using a blend refrigerant, characterized by using a low temperature heat source thermoelectric conversion system using the blend refrigerant, the thermoelectric conversion system including a evaporator (8), wherein a sprinkler (7), a first heater (9-1) and a second heater (9-2) are successively arranged from the top down in the evaporator (8), a hotwell (1) containing the blend refrigerant is connected to the sprinkler (7) through a pipeline with a booster transfer pump (11), a steam dryer (6) is arranged at an upper part of the evaporator (8), the steam dryer (6) is connected with an intake end of a turbine (5) through a pipeline, the turbine (5) is connected with a generator (4), and an exhaust end of the turbine (5) is connected with a mixer (3) through a pipeline, a reflux device (10) is arranged at a lower part of the evaporator (8), the reflux device (10) is connected with the mixer (3) through a pipeline, and the mixer (3) is connected with a condenser (2), comprising the following steps:

step 1: the blend refrigerant in the hot well (1) is pumped into the sprinkler (7) inside the evaporator (8) through the booster transfer pump (11), the blend refrigerant comes into contact with the surface of the first heater (9-1) with temperature higher than the boiling temperature of the blend refrigerant through the sprinkler (7) to allow refrigerant with boiling temperature lower than the surface temperature of the first heater (9-1) in the blend refrigerant to partially vaporize;

step 2: vaporized refrigerant separated out first flows to the steam dryer (6), non-vaporized blend refrigerant enters the lower part of the evaporator (8) to form a level line (9-0), refrigerant below the level line (9-0) is unceasingly heated by a heat transfer surface of the second heater (9-2) with temperature higher than the boiling temperature of the blend refrigerant to unceasingly separate out vaporized refrigerant flowing to the steam dryer (6), and liquid particles in the vaporized refrigerant are removed in the steam dryer (6);

step 3: dry vaporized refrigerant from the steam dryer (6) is transfused to the turbine (5), the vaporized refrigerant is expanded to do work in blade passages of the turbine (5) to be converted into mechanical energy, and drive the generator (4) to supply electric power to a grid in the form of electricity, and exhaust steam with work done in the turbine (5) is discharged to the mixer (3);

step 4: remaining vaporized refrigerant below the level line (9-0) in the evaporator (8) and with partial boiling temperature lower than the surface temperature of the first heater (9-1) undergoes further vaporization under heating from the heat transfer surface of the second heater (9-2), and non-vaporized refrigerant with high density tends to stay at the lower part of the evaporator (8) to form an area with minimum concentration of refrigerant components with the boiling temperature lower than the surface temperature of the first heater (9-1); and step 5: a refrigerant lean liquid is taken from the reflux device (10) based on a total amount of refrigerant pumped by the booster transfer pump (11) into the evaporator (8) as well as a component ratio of the refrigerant with the boiling temperature lower than the surface temperature of the first heater (9-1) and the level line (9-0), and delivered to the mixer (3) to mix with a discharged exhaust steam with work done in the turbine (5), the exhaust steam and the non-vaporized blend refrigerant are fully mixed in the mixer (3), and then led to the condenser (2), after the steam and liquid mixture is cooled in the condenser (2), vaporized refrigerant of the steam and liquid mixture is gradually absorbed by the refrigerant lean liquid, and the mixture is finally sent into the hot well (1) in a liquid state to complete a thermoelectric conversion cycle;

wherein an amount of the refrigerant lean liquid taken from the reflux device (10) is controlled by multi-impulse control of the level line (9-0) of the evaporator (8), reference parameters for multi-impulse control of the level line (9-0) of the evaporator (8) include flow, temperature and density of vaporized refrigerant at an inlet of the turbine (5), flow, temperature and density of liquid refrigerant at an outlet of the booster transfer pump (11), and flow, temperature and density of the refrigerant lean liquid in the pipeline between the outlet of the reflux device (10) and an inlet of the mixer (3).

* * * * *